United States Patent [19]

Roberts

[11] 4,248,121

[45] Feb. 3, 1981

[54] PULSE GENERATOR FOR PRODUCING THE HARMONIC EQUIVALENT OF A SAWTOOTH WAVE

[75] Inventor: Patrick S. Roberts, Rolling Meadows, Ill.

[73] Assignee: Whirlpool Corporation, Benton Harbor, Mich.

[21] Appl. No.: 71,096

[22] Filed: Aug. 31, 1979

[51] Int. Cl.[3] ..... G10H 1/12; G10H 5/12

[52] U.S. Cl. ..... 84/1.19; 84/1.21; 84/DIG. 9; 307/261; 307/266; 307/295; 328/167

[58] Field of Search ..... 84/1.11, 1.12, 1.19, 84/1.21-1.24, DIG. 9; 307/261, 266, 295; 328/167; 333/167, 172

[56] References Cited

U.S. PATENT DOCUMENTS

| | | | |
|---|---|---|---|
| 3,443,463 | 5/1969 | Campbell | 84/1.19 X |
| 3,505,461 | 4/1970 | Omura et al. | 84/1.19 X |
| 3,532,799 | 10/1970 | Kameoka et al. | 84/1.12 |
| 3,885,489 | 5/1975 | Sasaki | 84/1.11 X |
| 3,930,429 | 1/1976 | Hill | 84/1.19 X |
| 3,992,973 | 11/1976 | Howell | 84/1.23 |
| 4,002,095 | 1/1977 | Mantani | 84/1.22 X |
| 4,104,946 | 8/1978 | Peterson | 84/1.24 |
| 4,189,970 | 2/1980 | Woron | 84/1.19 |

*Primary Examiner*—S. J. Witkowski

*Attorney, Agent, or Firm*—Wegner, Stellman, McCord, Wood & Dalton

[57] ABSTRACT

An electronic organ tone generating technique produces a harmonic equivalent of a sawtooth wave. In one embodiment square waves generated by a conventional tone generator are applied to a one shot multivibrator, the output of which is a series of narrow rectangular pulses having a flat harmonic spectrum with both even and odd harmonics present. The narrow rectangular pulses are applied to a 3db per octave filter to produce a waveform, the harmonic content of which is equivalent to that of a sawtooth wave. In this embodiment, the pulse width remains constant regardless of the frequency of the pulse train. In a second embodiment, the duty cycle at each octave when moving up the keyboard is doubled to compensate for amplitude falloff which may occur in the filtered signal.

16 Claims, 19 Drawing Figures

PULSE GENERATOR FOR PRODUCING THE HARMONIC EQUIVALENT OF A SAWTOOTH WAVE

BACKGROUND OF THE INVENTION

This invention relates to an organ tone generating apparatus and method producing a sound similar to that produced by a sawtooth wave for such complex musical sounds as a trombone, trumpet, tuba, or the like.

Prior electronic organs have simulated the sawtooth waveform by using relatively complex circuitry, such as staircase generators. The prior art devices have adjusted the amplitude of the generated sawtooth wave by means of mixing resistors and the like, and often do not produce all the desired harmonics which are found in a true sawtooth wave. A plurality of filters has also been required to modify the generated sawtooth waveform in order to produce the desired voice. Such approaches to the generation of a sawtooth wave have had the serious disadvantage of being relatively complex and costly.

SUMMARY OF THE INVENTION

It is therefore a principal feature of the present invention to provide a relatively simple, inexpensive circuit which obtains substantially the same quality of sound as produced by a true sawtooth wave without actually generating such a waveform.

The present invention produces a sound similar to that produced by a sawtooth wave by utilizing a narrow duty cycle rectangular pulse generator, the output of which is passed through a single 3 db per octave filter. The rectangular pulses generated are sufficiently narrow to have a relatively flat harmonic spectrum over the audible range and contain both the even and odd harmonics. When these pulses are applied to the 3 db per octave filter, a waveform is produced having a harmonic spectrum equivalent in essential respects to that of a sawtooth wave.

To compensate for undesirable emplitude falloff of the filtered pulse train as its frequency increases, the duty cycle of the pulse train may be increased directly with increasing frequency or doubled at each higher octave. Thus, the invention facilitates tone production for complex musical sounds by varying the duty cycle of the pulse train rather than the amplitude of the generated waveform.

DESCRIPTION OF THE PREFERRED EMBODIMENT

Figure 1:
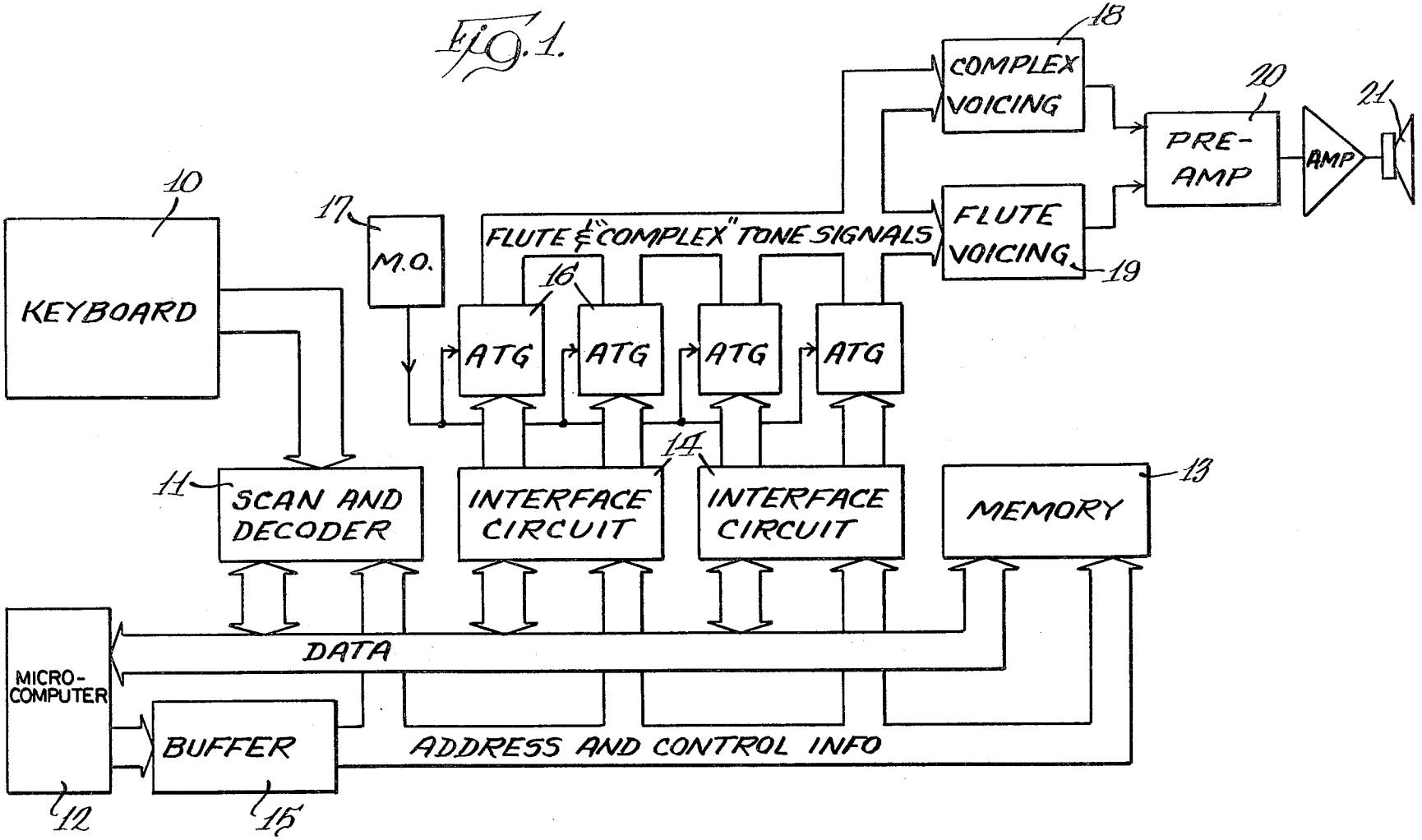
FIG. 1 is a simplified block diagram of an organ utilizing the present invention.

A simplified block diagram of an electronic organ utilizing the present invention is shown in FIG. 1. The organ comprises a keyboard 10 which is scanned by a scan decoder 11 under the control of a microcomputer 12. The microcomputer transfers data stored in a memory 13 containing such control parameters required for producing a trumpet sound or other complex voices to an interface circuit 14 on a data bus, with the memory 13 being addressed by microcomputer 12 through a buffer 15. The interface circuits 14 convert parallel data from the computer 12 to serial form for use by assignable tone generators 16. Under the control of a 3 MHz oscillator 17 the assignable tone generators 16 generate a pulse train having a frequency determined by the pitch of the notes selected on keyboard 10. The pulse trains are fed to a complex voicing filter 18 or a flute voicing filter 19 the output of which is amplified by amplifiers 20 and converted to sound by a speaker 21. The present invention forms part of the assignable tone generators 16 and a low pass filter circuit found in the complex voicing block 18. The remaining portions of these circuits and the rest of the organ may be conventional.

Figure 2:
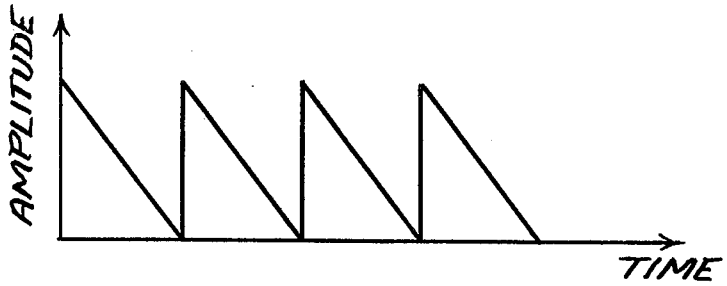
FIG. 2 illustrates a sawtooth wave.

The harmonic spectrum of a sawtooth waveform shown in FIG. 2 has desirable characteristics for production of certain complex orchestral sounds. The Fourier series for a sawtooth waveform is represented by the following equation:

$$C_n = 2A_{av}\frac{1}{\pi n}$$

where $C_n$=amplitude of the nth harmonic $A_{av}$=average amplitude of sawtooth waveform.

Figure 3:
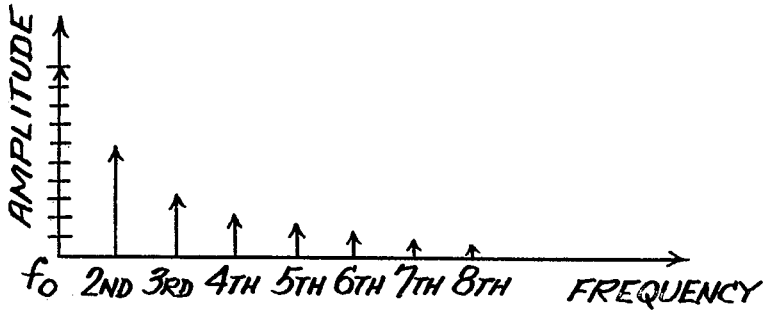
FIG. 3 illustrates the Fourier Series - Harmonic spectrum of a sawtooth wave.

The Fourier series coefficients for a sawtooth waveform of the type illustrated in FIG. 2 are illustrated in FIG. 3. As can be seen from the above equation and FIG. 3, both even and odd harmonics are present, and hence available for the production by the organ of the desired complex musical sounds.

Figure 4:
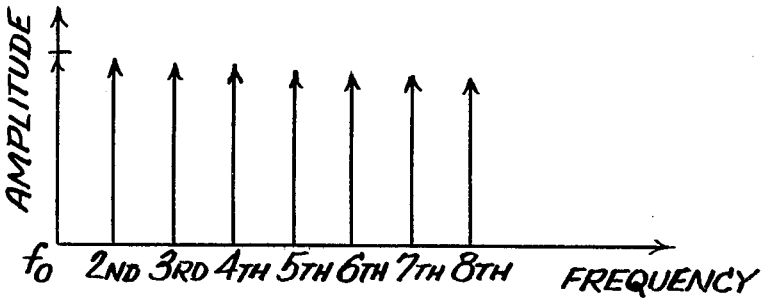
FIG. 4 illustrates the Fourier Series - Harmonic spectrum of a 1/32 duty cycle rectangular pulse train.
Figure 5:
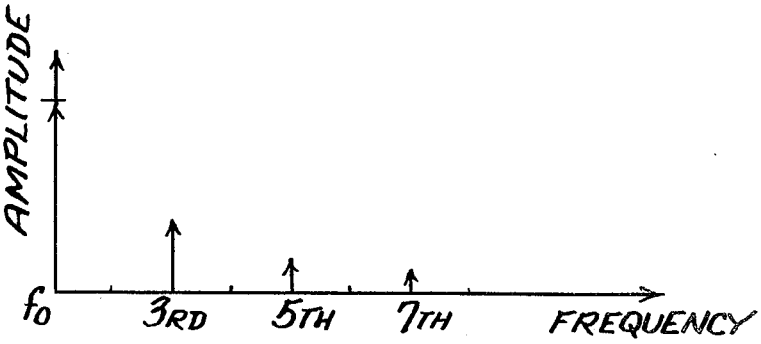
FIG. 5 illustrates the Fourier Series - Harmonic spectrum of a square wave.

While a square wave produces only odd harmonics which fall off rapidly in amplitude, as seen in FIG. 5, both even and odd harmonics with relatively constant amplitude are present in the Fourier series for a norrow duty cycle rectangular pulse train, as seen in FIG. 4. The harmonic coefficients $C_n$ for a narrow duty cycle retangular pulse train are found from the following equation:

$$C_n\ 2A_{av}\left|\frac{\sin n\pi\ t_o/T}{n\pi\ t_o/T}\right|$$

where $t_o/T$=duty cycle

Figure 6:
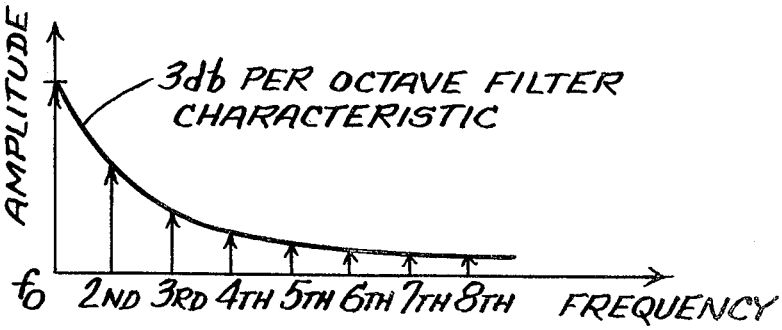
FIG. 6 illustrates the Fourier Series - Harmonic spectrum of a 1/32 duty cycle rectangular pulse train passed through a 3 db per octave filter.

When a narrow duty cycle pulse train is fed through a 3 db per octave filter, the Fourier coefficients as shown in FIG. 6 approximate those of the sawtooth waveform shown in FIG. 3. A narrow duty cycle pulse train passed through a 3 db per octave filter will therefore produce a sound similar to that generated by a sawtooth wave.

Figure 7:
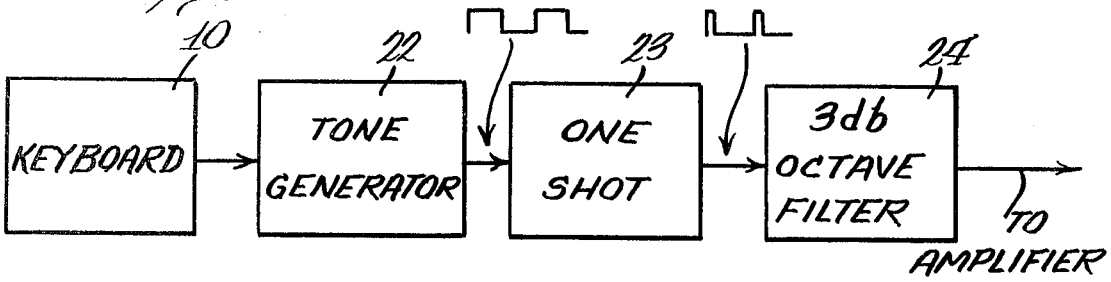
FIG. 7 is a block diagram of one embodiment of the present invention.

The waveform whose Fourier coefficients are shown in FIG. 6 is generated by the system shown in FIG. 7. A conventional tone generator 22 generates a square wave, the frequency of which is equal to the frequency of the note selected on keyboard 10. The output square wave from tone generator 22 is input to a conventional one shot multivibrator 23 which produces a series of narrow pulses at the frequency of the selected note. These pulses have a generally flat harmonic spectrum throughout the audible range as shown in FIG. 4. The narrow pulses are input to a 3 db per octave filter 24 the output of which is fed to an amplifier and converted to sound.

The pulses thus produced have a constant width regardless of the frequency of the pulse train. As one moves up the keyboard to the highest note, the frequency of the pulse train increases and the duty cycle approaches 50%. The harmonic spectrum for a pulse train approaching 50% duty cycle remains flat for only the first few harmonics, falling off rapidly in amplitude thereafter. For high notes, however, only the first few harmonics will be within the audible range. Thus, the harmonic spectrum of pulses for notes at the higher end of the keyboard need not be flat over as wide a range as the harmonic spectrum of pulses generated for notes at the lower end of the keyboard having a large number of harmonics within the audible range. The constant width pulses will produce the desired results as long as the duty cycle is sufficiently narrow to produce an essentially flat harmonic spectrum over the audible range for the selected note.

The circuit shown in FIG. 7 produces a narrow duty cycle pulse train in which the duty cycle varies directly and continuously as a function of the frequency of the note selected. The pulse train generated by the circuit of FIG. 8 has a duty cycle which is changed only at each octave. Specifically the duty cycle is doubled at each octave as one moves up the keyboard.

Figure 8:
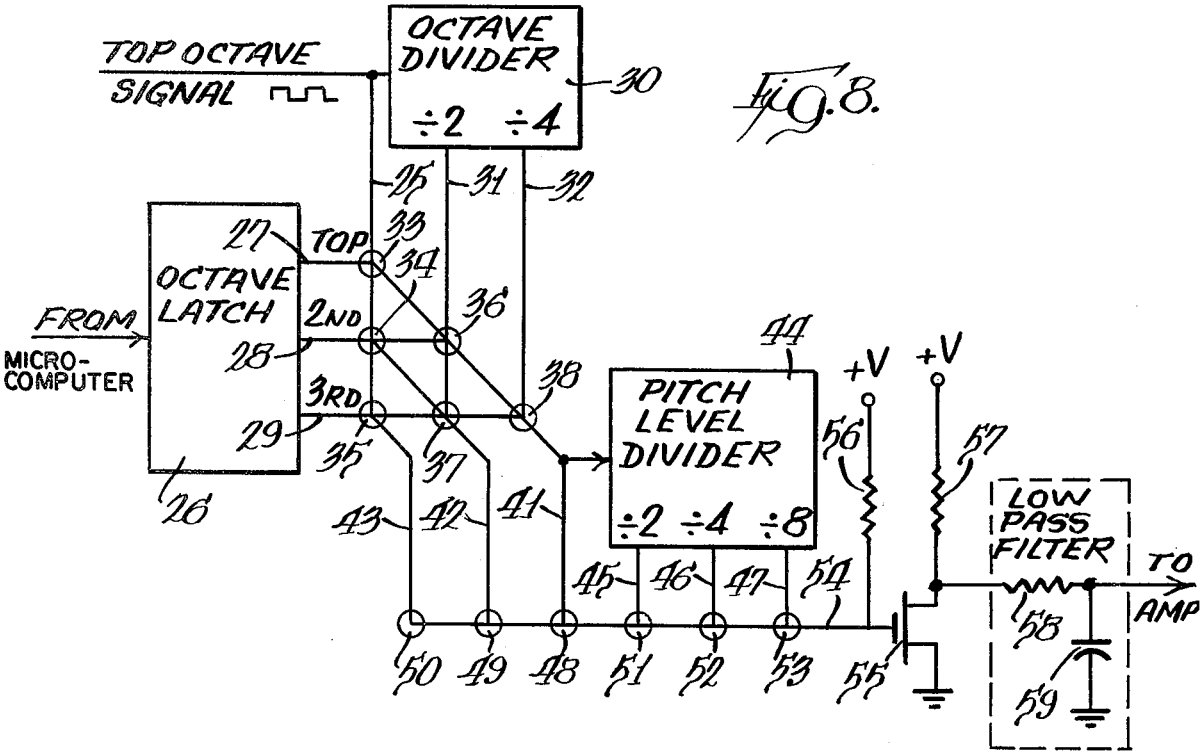
FIG. 8 is a block diagram of a second embodiment of the present invention.

The circuit of FIG. 8 is intended for use in organs which employ a top octave generator or other tone generator source which produces a pulse train output having a frequency located within the top octave of the keyboard, regardless of the actual octave location of the key which has been depressed. Given this pulse train within the top octave, and the octave information derived from a keyboard scan circuit, the circuit shown in FIG. 8 will produce an output in the octave selected. Any of various conventional means may be used to develop the top octave signal and octave information.

As seen in FIG. 8, a pulse train from a top octave source within the assignable tone generators 16 appears on line 25 and is coupled to an octave divider 30 which devides the frequency by two, the output appearing on line 31, and also divides the frequency by four, the output of which appears on line 32. The circuit includes an octave latch 26, having outputs 27, 28 and 29 which represent the top, middle and lower octaves, respectively. Depending on which of the outputs 27, 28 or 29 is energized, the pulse trains appearing on lines 25, 31 and 32 will be variously applied by means of couplers 33–38 to lines 41, 42 and 43.

Figure 8A:
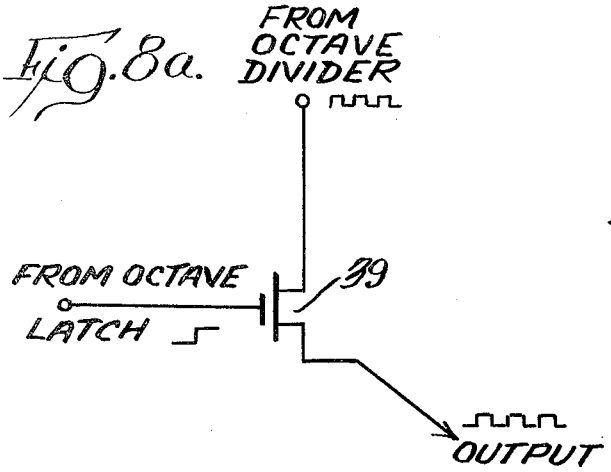
FIG. 8*a* illustrates the coupler of FIG. 8 in greater detail.

Couplers 33–38 are shown in more detail in FIG. 8*a*. Each coupler comprises a field effect transistor 39 the gate of which is connected to one of the outputs 27, 28 or 29 of the octave latch 26. The drain of transistor 39 is connected to an output from the octave divider 30 and the source of transistor 39 is connected to one of the lines 41, 42 or 43. The outputs from the couplers thus appear on lines 41, 42 and 43. The output on diagonal 41 is input to a pitch level divider 44 which divides the frequency of the incoming pulse train by 2, 4 and 8, the outputs of which appear on lines 45, 46, 47, respectively.

As will be more fully appreciated later, the octave latch 26 and the couplers 33–38 together form an octave select means which determines the octave location of the signal produced by the circuit of FIG. 8.

Figure 8B:
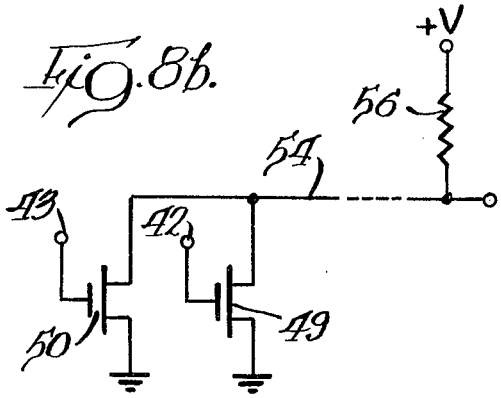
FIG. 8*b* illustrates the field effect transistors of FIG. 8 in greater detail.

Lines 41–43 and 45–47 are connected to the inputs of field effect transistors 48–50 and 51–53 respectively. As shown in more detail in FIG. 8*b*, each of the transistors 48–53 has its drain connected to a bus 54, which is connected in turn to a positive voltage source by a pull-up resistor 56. Each of the transistors 48–53 has its source grounded. Transistors 48–53 operate as a NOR gate with selected inputs from the octave divider 30 and pitch level divider 44 on lines 41–43 and 45–47. If any of these inputs go high, the normally high signal on bus 54 will go low, turning off a field effect transistor 55.

The gate of transistor 55 is connected to line 54 and its drain is connected to a positive voltage through a resistor 57, the transistor's source being grounded. The output of transistor 55 is fed to a low pass filter comprising a resistor 58 and a capacitor 59, the output of which is amplified and converted to sound.

The time constant of the low pass filter should be selected so that the output from the filter will be down by 3 db at a frequency one octave above the fundamental frequency of the lowest note on the keyboard. By way of example, for a keyboard having the note F at 196 $H_z$ as the lowest note, resistor 58 may have a value of 4 K ohms and capacitor 59 may have a value of 0.1 $\mu$f.

The operation of the circuit shown in FIG. 8 will now be described in relation to FIGS. 9*a–f* and FIGS. 10*a–c*.

Figures 9, 10:
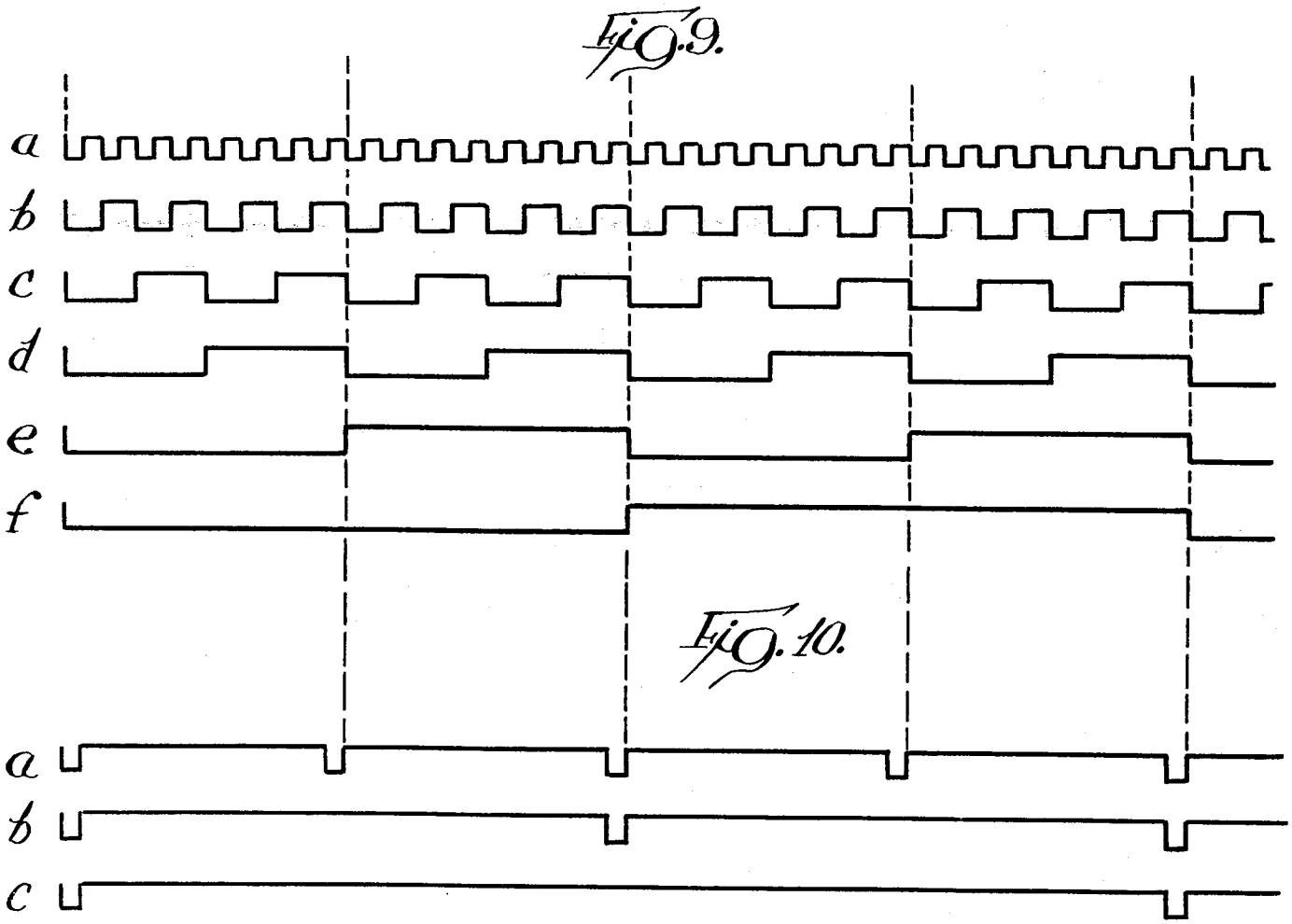
FIGS. 9*a–f* and 10*a–c* are waveform diagrams illustrating the present invention.

The waveform of FIG. 9*a*, generated by a top octave generator appears on line 25 and is fed to the octave divider 30. The octave divider 30 divides the frequency of this pulse train such that the waveforms of FIGS. 9*b* and *c* appear on the output lines 31 and 32 respectively.

The octave latch 26 receives an input signal from microcomputer 12 designating the desired octave. This input is decoded and one of the outputs 27, 28 or 29 is latched on in a high state. If, for example, the second octave is selected, a signal would appear on line 28 gating on the couplers 34 and 36 to allow the pulse trains appearing on lines 25 and 31 to pass to lines 42 and 41 respectively. The waveforms of FIGS. 9*a* and *b* would thus pass to lines 42 and 41 respectively when the second octave has been selected.

The waveform of FIG. 9*b* appearing in this example on line 41 is fed to the pitch level divider 44 which produces the pulse trains of FIGS. 9*c*, *d* and *e* on output lines 45–47 respectively. Waveforms 9*a–e* appear at the gates of transistors 49, 48 and 51–53 respectively when the second octave has been selected.

Table I shows the input waveforms of FIGS. 9*a–f* to the NOR gate comprised of field effect transistors 48–53 for each of the octaves selected by octave latch 26.

TABLE I

| Octave | Inputs to NOR gate | | | | | |
|---|---|---|---|---|---|---|
| Selected | 50 | 49 | 48 | 51 | 52 | 53 |
| Top | — | — | a | b | c | d |

TABLE I-continued

| Octave | Inputs to NOR gate | | | | | |
|---|---|---|---|---|---|---|
| Selected | 50 | 49 | 48 | 51 | 52 | 53 |
| 2nd | — | a | b | c | d | e |
| 3rd | a | b | c | d | e | f |

If any of the inputs to transistors 48–53 go high, line 54 goes low turning off field effect transistor 55. As can be seen from the waveforms 9*a*–9*f*, at least one of the inputs to transistors 48–53 is usually high. When transistor 55 is turned on, its output goes low, producing a narrow duty cycle, negative-going pulse train.

In the above example in which the second octave has been selected, the waveform of FIG. 10*b* which is a 1/32 duty cycle pulse train is fed from field effect transistor 55 to the low pass filter comprised of resistor 58 and capacitor 59.

If the top octave had been selected, the waveforms of FIGS. 9*a*–*d* would have been input to the NOR gate comprised of transistors 48–53 and the output of transistor 55 would be a 1/16 duty cycle pulse train having a frequency one octave higher than in FIG. 10*b*, as shown in FIG. 10*a*. Similarly, had the third octave been selected, the waveforms of FIGS. 9*a*–*f* would be input to the NOR gate and the 1/64 pulse train of FIG. 10*c* would result at the output of transistor 55, having a frequency one octave lower than in FIG. 10*b*.

The output pulse train of transistor 55 thus has a duty cycle which is doubled for each higher octave, i.e., 1/64 duty cycle for the 3rd octave; 1/32 for the 2nd octave and 1/16 for the top octave. Increasing the duty cycle of a pulse train as a function of its frequency compensates for amplitude falloff which occurs as the frequency of the pulse train passing through the filter increases. If the circuit did not provide this automatic adjustment of the duty cycle, it would be necessary to provide separate filters or complex amplitude compensation means for each octave on the keyboard. The circuit and technique of the present invention have been found to produce good quality sound while yet obviating the need for more complex, hence, costly circuitry.

When the narrow duty cycle pulse train is passed through the low pass filter, which in the present embodiment is a 3 db per octave filter, the resulting signal has the Fourier series shown in FIG. 6 which is a harmonic equivalent of a sawtooth wave. The signal thus produced may be used to generate such tones as a trumpet, trombone, tuba and other complex musical sounds which are advantageously derived from a sawtooth-like waveform.

Having described the invention, the embodiments of the invention in which an exclusive property or privilege is claimed are defined as follows:

1. In an electronic musical instrument having means for selecting any one of a pluraltiy of different pitch musical tones to be produced, a system for producing said selected tone comprising:

means for generating a narrow duty cycle rectangular pulse train having a frequency proportional to and a duty cycle varying directly with the pitch of the selected tone, said duty cycle being equal to or less than 50% to cause the harmonic spectrum of said pulse train to be substantially flat over the audible range.

2. The electronic musical instrument of claim 1 wherein said filter means comprises a 3 db per octave low pass filter.

3. The electronic musical instrument of claim 1 wherein said means for generating the pulse train comprises a series connected tone generator and one shot multivibrator.

4. In an electronic musical instrument having means for selecting any one of a plurality of different pitch musical tones to be produced, a system for producing said selected tone comprising:

means for generating a plurality of pulse trains having frequencies different from each other by powers of two and proportional to the pitch of the selected tone, including a first pulse train having the highest frequency;

octave select means coupled to the pulse train generating means to pass selected ones of the generated pulse trains;

means for combining the pulse trains passed by the octave select means to produce a narrow duty cycle pulse train having a duty cycle equal to or less than 50% and varying directly with the octave of the selected tone;

single filter means for causing the harmonic spectrum of the pulse train to approximate the harmonic spectrum of a sawtooth wave; and, means for converting the filtered pulse train to sound.

5. The electronic musical instrument of claim 4 wherein said means for generating a pluraltiy of pulse trains includes a divider means for dividing the frequency of said first pulse train by powers of two.

6. The electronic musical instrument of claim 4 wherein said means for combining the pulse trains includes a NOR gate.

7. The electronic musical instrument of claim 4 wherein the duty cycle is doubled at each higher octave.

8. The electronic musical instrument of claim 4 wherein the filter means is a 3 db per octave low pass filter.

9. The electronic musical instrument of claim 4 wherein said octave select means comprises an octave latch having a plurality of outputs corresponding to the octaves in which said selected tone may fall and a matrix of couplers connected to said latch outputs and to said pulse train generating means for selectively coupling said pulse trains to said pulse train combining means.

10. In an electronic musical instrument having means for selecting any one of a pluraltiy of different pitch musical tones to be produced, a system for producing said selected tones comprising:

means for generating a plurality of pulse trains having frequencies different from each other by powers of two and proportional to the pitch of the selected tone;

octave select means coupled to the pulse train generating means to pass selected ones of the generated pulse trains;

divider means for dividing the lowest frequency pulse train passed by the octave select means to generate a further plurality of pulse trains;

means for combining the pulse trains passed by the octave select means and generated by the divider means to produce a narrow duty cycle rectangular pulse train, said duty cycle being equal to or less than 50%;

single filter means for causing the harmonic spectrum of the pulse train to approximate the harmonic spectrum of a sawtooth wave; and means for converting the filtered pulse train to sound.

11. The electronic musical instrument of claim 10 wherein the divider means divides the frequency of the lowest frequency pulse train by powers of two.

12. The electronic musical instrument of claim 10 wherein the duty cycle of the rectangular pulse train is doubled at each octave.

13. The electronic musical instrument of claim 10 wherein the filter means is a 3 db per octave low pass filter.

14. A method for producing any one of a plurality of musical tones having a predetermined harmonic content, comprising the steps of:

selecting the pitch of a musical tone to be produced;

generating a rectangular pulse train having a frequency proportional to and a duty cycle varying directly with the selected pitch, said duty cycle being equal to or less the 50% to cause the harmonic spectrum of the pulse train to be substantially flat over the audible range;

passing said pulse train through a filter having characteristics approximating the harmonic spectrum of a sawtooth wave; and converting said filtered pulse train to sound.

15. The method of producing musical tones of claim 14 wherein the filter is arranged to reduce the harmonic spectrum of the pulse train 3 db per octave.

16. A method for producing any one of a plurality of musical tones having a predetermined harmonic content, comprising the steps of:

selecting the pitch of a musical tone to be produced;

generating a narrow duty cycle rectangular pulse train having a frequency proportional to the selected pitch, with said duty cycle being equal to or less than 50%;

doubling the duty cycle of said pulse train at each higher octave;

passing said pulse train through a filter having a filter characteristic approximating the harmonic distribution of a sawtooth wave; and, converting said filtered pulse train to sound.

* * * * *